US005209653A

United States Patent [19]

Murray et al.

[11] Patent Number: 5,209,653

[45] Date of Patent: May 11, 1993

[54] VACUUM PUMP

[75] Inventors: Gary P. Murray, Montpelier; Harold E. Lyons, Bryan, both of Ohio; Richard D. Parks, Horton, Mich.

[73] Assignee: SPX Corporation, Muskegon, Mich.

[21] Appl. No.: 822,408

[22] Filed: Jan. 17, 1992

[51] Int. Cl.[5] ..... F04B 35/04

[52] U.S. Cl. ..... 417/410 R; 417/423.14; 417/435

[58] Field of Search ..... 417/410, 423.14, 435; 418/96, 13

[56] References Cited

U.S. PATENT DOCUMENTS

| | | | |
|---|---|---|---|
| 2,300,110 | 10/1942 | Hoog | 417/435 |
| 2,386,765 | 10/1945 | Adams et al. | 137/533.11 |
| 2,737,686 | 3/1956 | Harkenrider | 417/435 |
| 3,525,578 | 8/1970 | Blair, Jr. | 418/13 |
| 3,838,950 | 10/1974 | Andriulis | 418/96 |
| 4,523,897 | 6/1985 | Lower et al. | 417/244 |
| 4,540,353 | 9/1985 | Murray | 418/13 |
| 4,631,006 | 12/1986 | Murray | 417/234 |

*Primary Examiner*—Richard A. Bertsch
*Assistant Examiner*—Charles G. Freay
*Attorney, Agent, or Firm*—Barnes, Kisselle, Raisch, Choate, Whittemore & Hulbert

[57] ABSTRACT

A vacuum pump that includes an electric motor and a pump module mounted to the motor housing with the motor shaft being rotatably coupled to a pumping mechanism within the pump module. A pump inlet and a pump outlet are respectively coupled to the pumping mechanism within the pump module for pumping air from the inlet to the outlet upon operation of the motor. An inlet valve is carried by the pump, and is selectively movable by an operator between an open position in which the pump inlet port is coupled to the pumping mechanism and a closed position in which the inlet port is isolated from the pumping mechanism. In this way, the pumping mechanism may be connected to a system under service by placing the inlet valve in the open position to evacuate the system, and may be isolated from the system under service without disconnection therefrom by placement of the inlet valve in the closed position during service on or charging of the system.

30 Claims, 7 Drawing Sheets

VACUUM PUMP

The present invention is directed to vacuum pumps, and more particularly to improvements in vacuum pumps of the character disclosed in U.S. Pat. Nos. 4,523,897, 4,540,353 and 4,631,006.

BACKGROUND AND OBJECTS OF THE INVENTION

The above-noted U.S. patents, all of which are assigned to the assignee hereof, disclose compact portable vacuum pumps that find particular utility in evacuating a refrigeration system—e.g., an air conditioning or heat pump system—prior to charging the system with refrigerant. A pump module, containing a single-stage or two-stage rotary vane pumping mechanism, is mounted to one end of an electric motor. The pumping mechanism is rotatably coupled to the motor output shaft for drawing air through an inlet port to the pumping mechanism, and then pumping the air to and through an outlet port. The pumping mechanism is immersed in oil enclosed within the pump module, and baffles are arranged between the outlet of the pumping mechanism and the outlet port to prevent pumping of oil to the atmosphere. A gas ballast communicates with the outlet of the pumping mechanism for selectively admitting dry air to the pump module, and thereby preventing condensation and collection of moisture within the pump module. A handle is affixed to the pump module or motor housing for portability of the pump, and may form part of the pump outlet passage.

Although the vacuum pumps disclosed in the noted patents have enjoyed substantial commercial acceptance and success, improvements remain desirable. It is a general object of the present invention to provide a vacuum pump of the described character having enhanced portability and versatility in operation. A more specific object of the present invention is to provide a vacuum pump of the described character having an inlet valve construction forming a part of the pump itself to isolate the vacuum pump during charging of the refrigeration system following evacuation thereof, while at the same time eliminating any need for disconnecting the vacuum pump from the system and/or providing a separate external inlet valve construction. In connection with the foregoing, it is another yet more specific object of the present invention to provide a vacuum pump having an inlet valve of the described character that may be readily and easily manipulated by an operator for selectively connecting or isolating the vacuum pumping mechanism from the system under service. A further object of the present invention is to provide a vacuum pump of the described character having an improved gas ballast valve arrangement that prevents reverse pumping of oil, for example, through the ballast valve.

SUMMARY OF THE INVENTION

A vacuum pump in accordance with the present invention includes an electric motor and a pump module mounted to the motor housing with the motor shaft being rotatably coupled to a pumping mechanism within the pump module. A pump inlet and a pump outlet are respectively coupled to the pumping mechanism within the pump module for pumping air from the inlet to the outlet upon operation of the motor. In accordance with a first aspect of the present invention, an inlet valve is carried by the pump, and is selectively movable by an operator between an open position in which the pump inlet port is coupled to the pumping mechanism and a closed position in which the inlet port is isolated from the pumping mechanism. In this way, the pumping mechanism may be connected to a system under service by placing the inlet valve in the open position to evacuate the system, and may be isolated from the system under service without disconnection therefrom by placement of the inlet valve in the closed position during service on or charging of the system.

In the preferred embodiment of the present invention, the pump module is mounted to the motor housing by an adapter within which a coupling interconnects the motor shaft to the drive shaft of the pumping mechanism. The pump inlet port and the pump outlet port are carried by the adapter, and are connected by associated inlet and outlet passages in the adapter to the pumping mechanism within the pump module. In this way, the pump module itself is essentially a closed modular construction that may be readily removed from the adapter for service or maintenance. The inlet valve in the preferred embodiment of the invention comprises a spool that extends laterally through the inlet passage in the adapter, with an opening that extends laterally through the spool at a position for alignment with the inlet passage as a function of rotation of the spool. A handle is positioned externally of the adapter and coupled to the spool for rotating the spool between a first position in which the opening in the spool is aligned with the inlet passage to connect the inlet port to the pumping mechanism, and a second position at which the opening in the spool is oriented at right angle to the inlet passage so as to isolate the inlet port from the pumping mechanism. Abutments are carried by the handle and by the external wall of the adapter for limiting rotation of the handle to 90°, and thereby for cooperating with the handle and the spool for defining the first and second positions of the spool at respective limits of rotation of the handle. The abutments in the preferred embodiment comprise a projection on an external surface of the adapter adjacent to the handle and an arcuate slot in the handle received over the projection. A resilient sealing ring is carried in a circular groove orthogonal to the spool opening on a side of the spool facing the inlet port to prevent leakage from the inlet port through the inlet passage around the spool in the closed position of the inlet valve.

In accordance with a second aspect of the present invention, which may be employed separately from or more preferably in combination with other aspects of the invention, a gas ballast valve is also mounted on the adapter, which has a gas passage that extends within the adapter from the ballast valve to the pump module. The gas ballast valve includes a check valve that prevents reverse flow through the gas ballast valve from the pumping mechanism, thereby preventing the pumping mechanism from pumping oil through the ballast valve. The check valve preferably comprises an annular gasket forming a valve seat within a substantially cylindrical portion of the gas passage, a check ball opposed to the valve seat, and a coil spring in the gas passage for urging the check ball against the seat. The coil spring seats against an opposing internal surface of the gas passage at a right-angle turn of the gas passage between the gas ballast valve and the pump.

In accordance with a third aspect of the present invention, which again may be employed separately from or more preferably in combination with other aspects of the invention, a hollow handle is mounted to the adapter and forms a part or extension of the outlet passage from the adapter to the outlet port formed by an open end of the handle remote from the adapter. The handle is mounted to the adapter by a hollow bolt that forms part of the outlet passage. The handle is substantially parallel to the motor drive shaft externally spaced from the motor and adapter, the hollow bolt opening laterally into the hollow handle. Most preferably, a second portion of the handle is externally affixed to the motor housing for balancing the load on the handle when the pump is carried. The second portion of the handle affixed to the motor is hollow and encloses the electrical connections associated with the motor, including the motor starting capacitor and on/off switch.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

The disclosures of above-noted U.S. Pat. Nos. 4,523,897, 4,540,353 and 4,631,006 are incorporated herein by reference for purposes of background.

Figure 1:
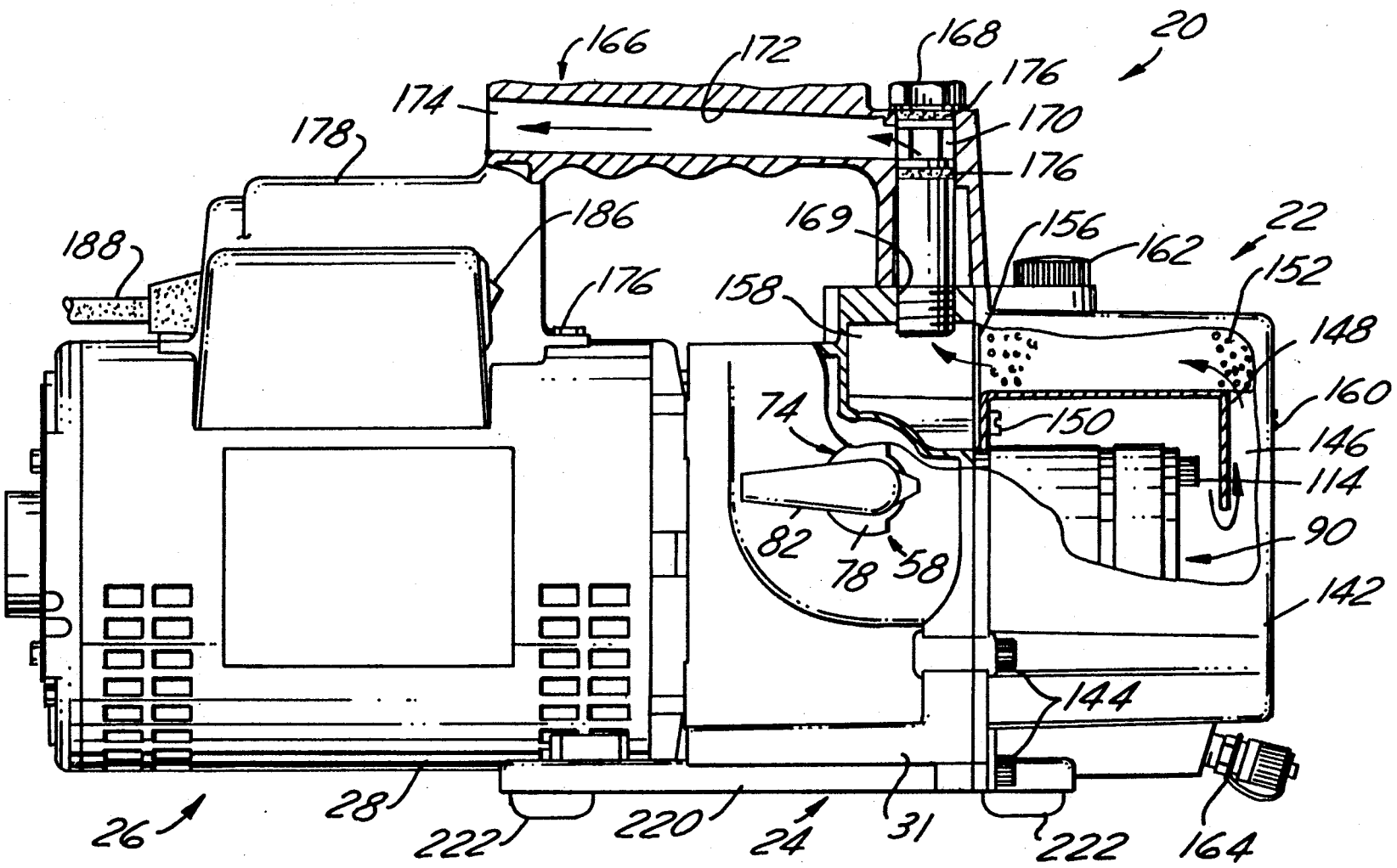
FIG. 1 is a partially sectioned side elevational view of a vacuum pump in accordance with a presently preferred embodiment of the invention.
Figure 6:
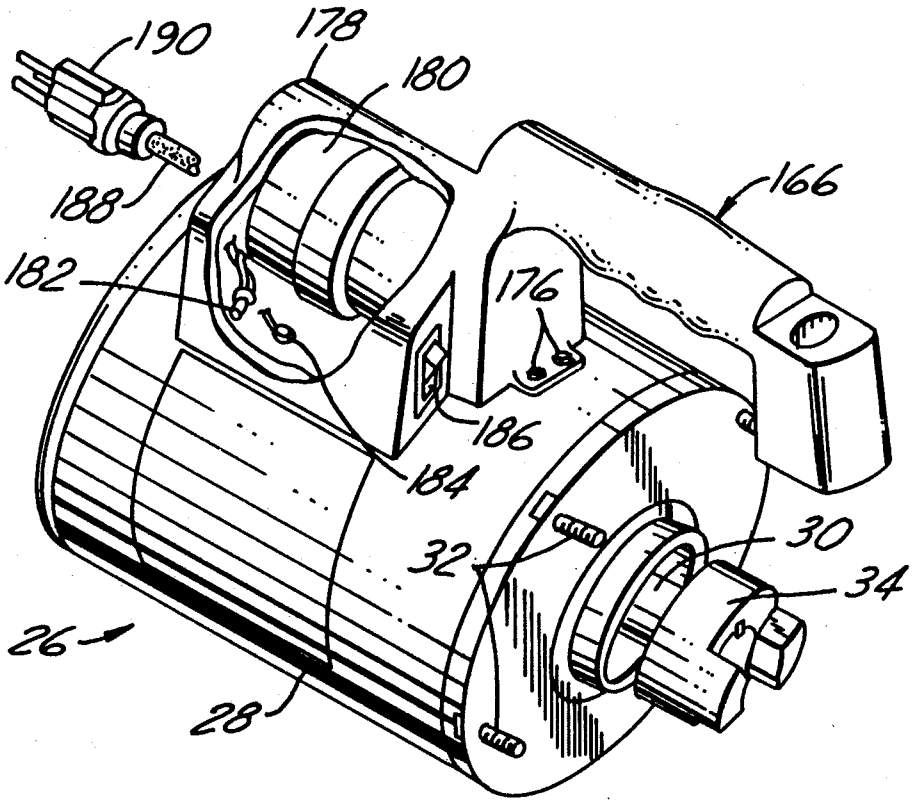
FIG. 6 is a partially sectioned perspective view of the motor and handle subassembly in the pump of FIG. 1 disassembled from the pump module and adapter.

The drawings illustrate a vacuum pump 20 in accordance with a presently preferred embodiment of the invention as comprising a pump module 22 (FIGS. 1, 2 and 4) mounted by an adapter 24 (FIGS. 1-4 and 9-10) to an electric motor 26 (FIGS. 1 and 6). Motor 26 includes a substantially cylindrical housing 28 (FIGS. 1 and 6) having a rotatable output shaft 30 projecting from one axial end thereof. Adapter 24 comprises a generally hollow casting 31 affixed to the bolts 32 (FIG. 6) that project from the end of motor housing 28 surrounding shaft 30. A coupler 34 is affixed to the free end of shaft 30 for mating engagement in assembly with an opposing coupler 36 (FIGS. 2 and 3) within adapter casting 31. An inlet tee 38 (FIGS. 2-4) is externally threadably mounted on adapter 24 and has a pair of threaded fittings 40,42 forming vacuum pump inlet ports of differing thread sizes. Ports 40,42 are normally closed by respective caps 44,46 when not in use.

Within adapter casting 31, inlet tee 38 is threadably received in the open end of an inlet passage 48 (FIGS. 3 and 9-10) that extends through the casting. A check ball 50 (FIG. 3) is captured by a retainer 52 in opposition to a tapered seat 54 within tee 38 to form an inlet check valve assembly. A conical filter screen 56 is carried by a shoulder 57 (FIGS. 3 and 9-10) within inlet passage 48 adjacent to tee 38 to prevent entry of metallic particles and the like. Beneath screen 56, an inlet valve assembly 58 extends laterally through inlet passage 48. Inlet valve 58 comprises a substantially cylindrical valve spool 60 (FIGS. 3 and 8-10) having a circular opening 62 that extends laterally through the spool at a position for alignment with inlet passage 48 in adapter casting 31. A resilient elastomeric sealing ring or O-ring 64 is received in a circular groove 66 (FIGS. 9 and 10) axially orthogonal to passage 62 for aligned registry with inlet passage 48 in the valve orientation illustrated in FIG. 10. A pair of O-rings 68,70 encircle spool 60 on opposed sides of passage 62 for rotatably slidably engaging opposing surfaces of adapter casting 31 for sealing spool 60 while permitting rotation thereof. A snap ring 72 captures spool 60 in assembly within adapter casting 31.

Figure 2:
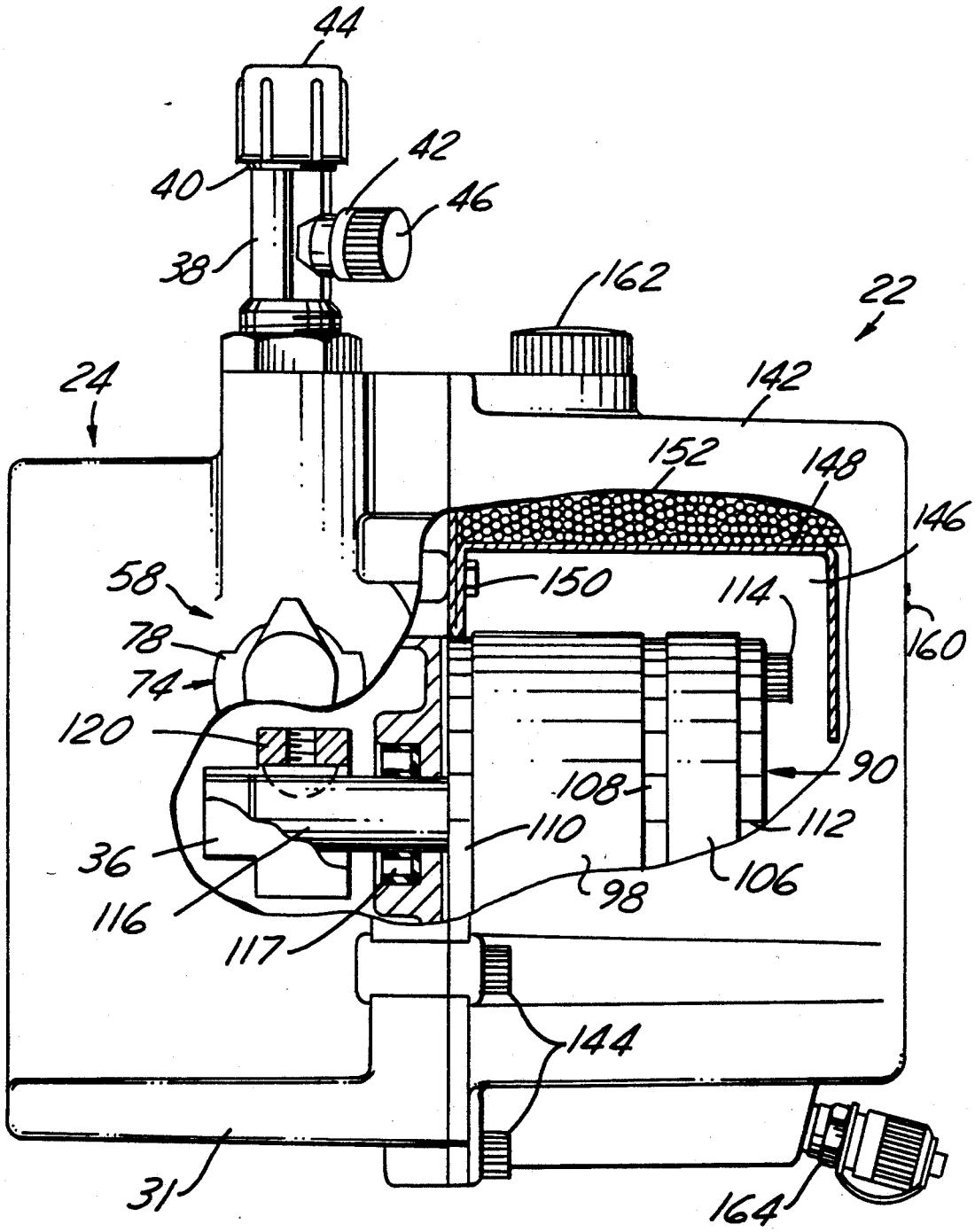
FIG. 2 is a partially sectioned side elevational view of the pump module and adapter in the pump of FIG. 1 disassembled from the motor.
Figure 3:
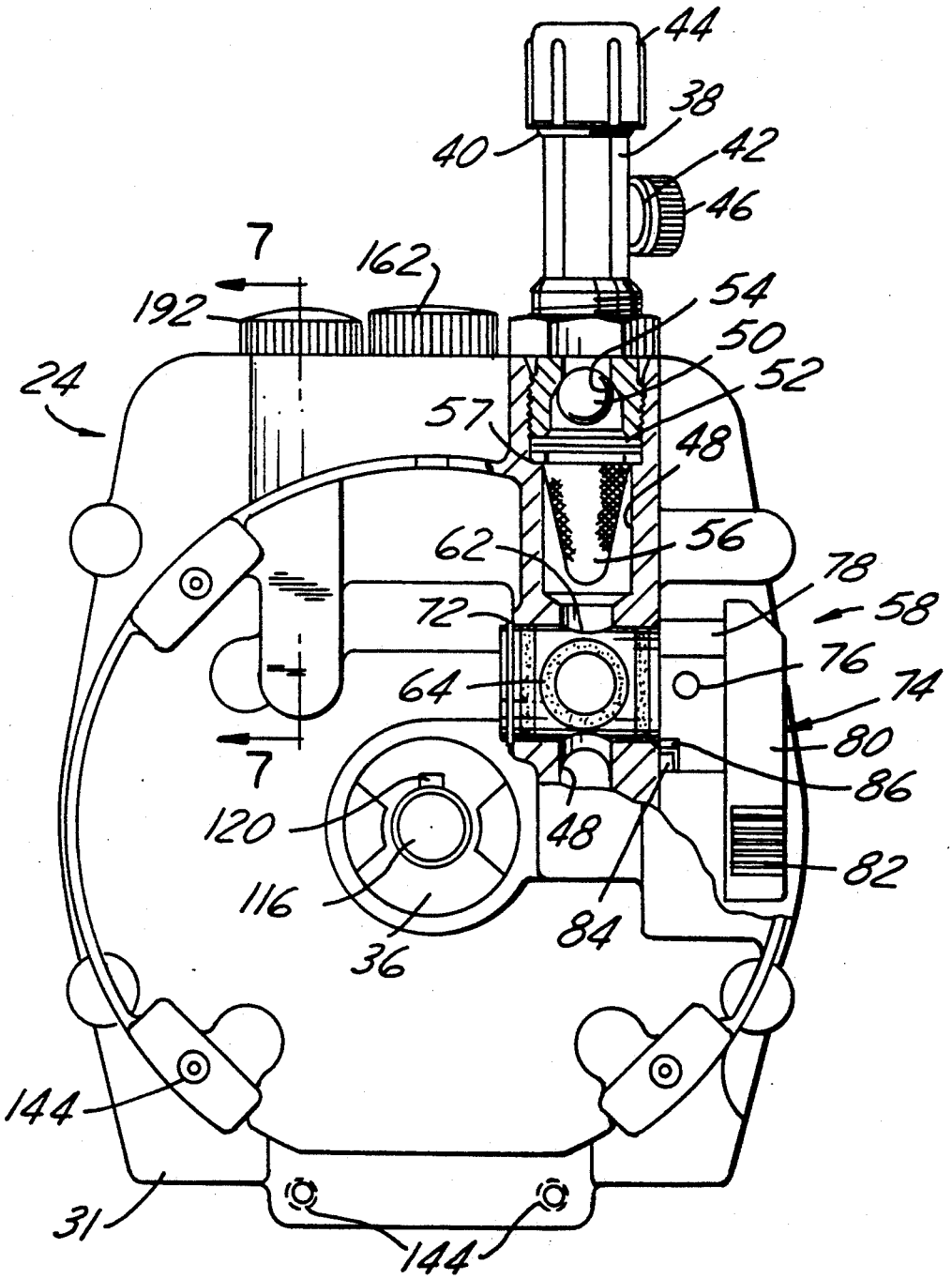
FIG. 3 is a partially sectioned end view of the module and adapter illustrated in FIG. 2.
Figure 4:
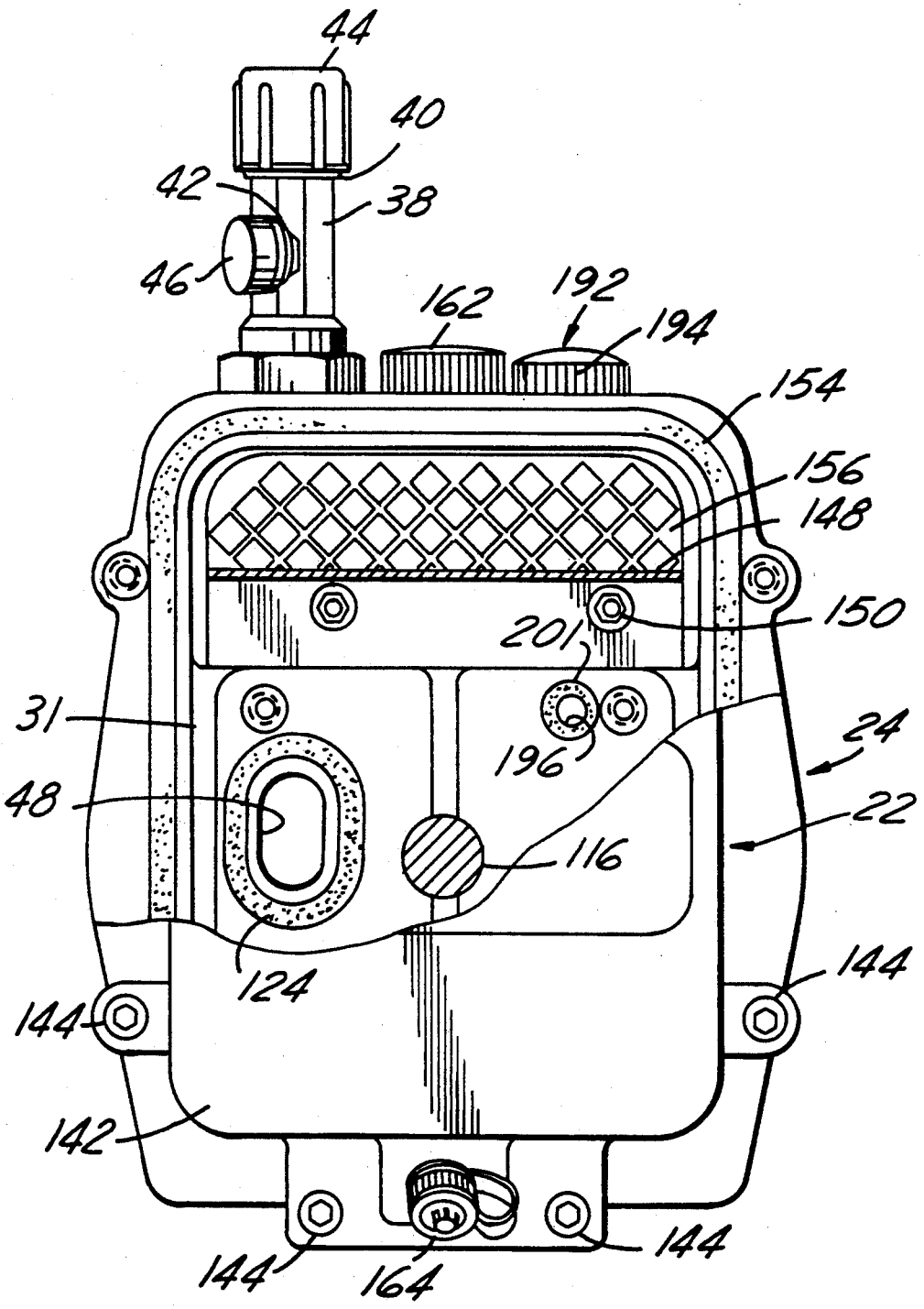
FIG. 4 is a partially sectioned view of the opposing end of the pump module and adapter illustrated in FIG. 2.
Figure 10:
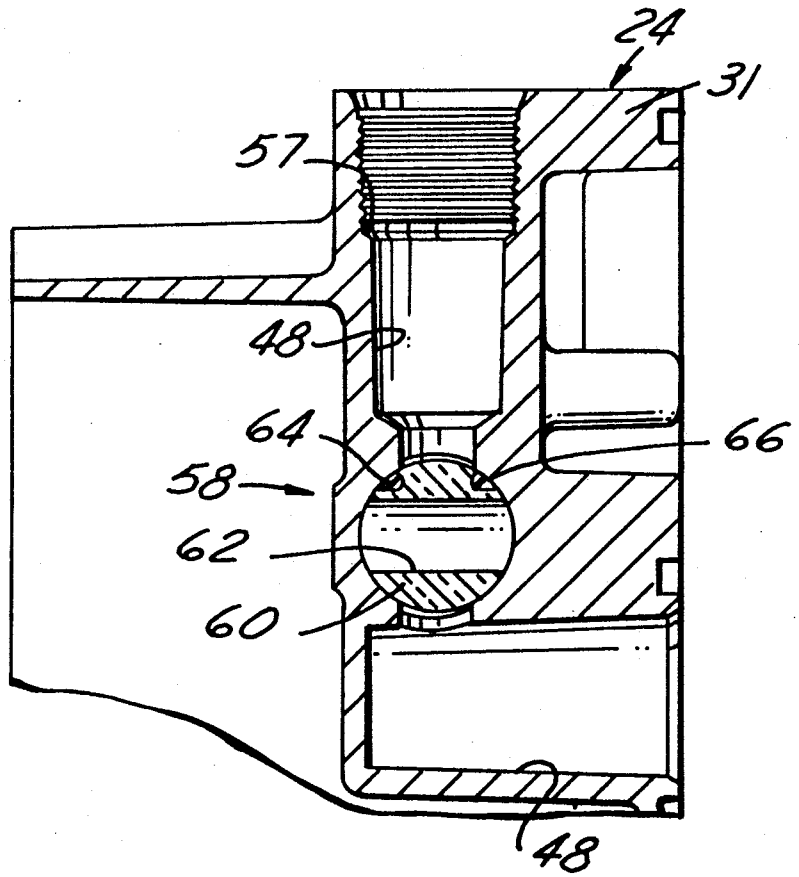
FIGS. 9 and 10 are fragmentary sectional views in side elevation of the pump adapter showing orientation of the inlet spool relative to the inlet passage in the open and closed positions of the valve respectively.
Figure 9:
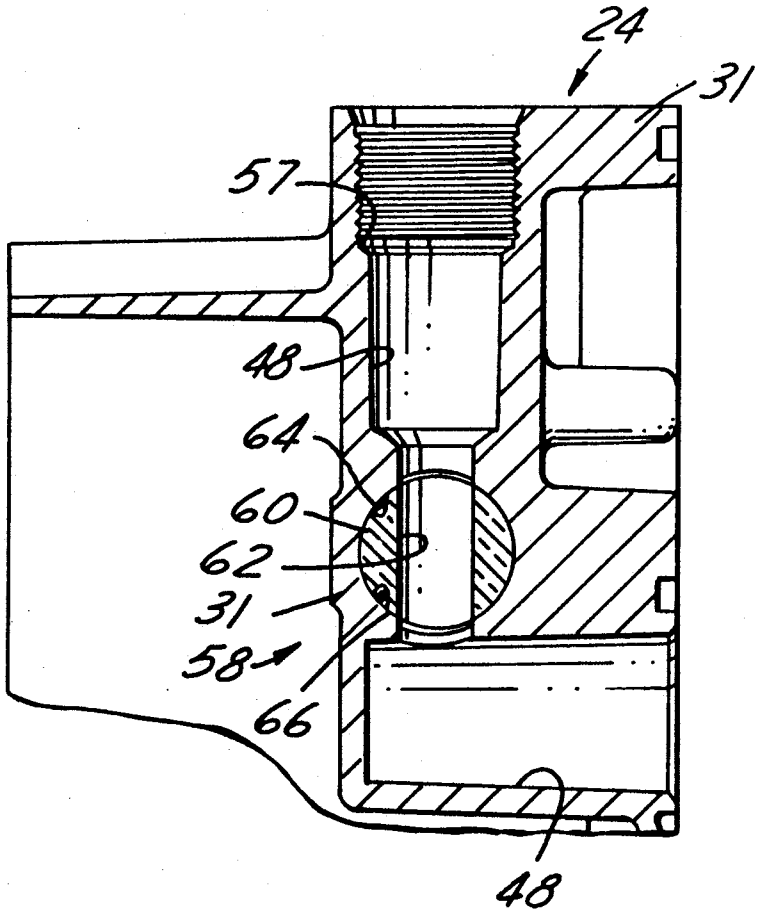

A handle 74 (FIGS. 1-3 and 8) is received over the end of spool 60 remote from snap ring 72 and externally of adapter casting 31. Handle 74 is affixed to the spool by a spring pin 76 that is press fitted through aligned openings in the shank 78 of handle 74 and the outer end of spool 60. The gripping portion 80 of handle 74 projects and tapers orthogonally from handle shank 78 and spool 60, and terminates in serrations 82 for enhanced manual grasping of the handle. A projection 84 (FIG. 3) on the external surface of adapter casting 31 is received in assembly within an arcuate slot 86 (FIGS. 3 and 8) on handle shank 78 for defining abutment stops against rotation of the handle at positions spaced 90° from each other. The first such position is illustrated in FIGS. 2-3 and 9, in which passage 62 within spool 60 is aligned with inlet passage 48 in adapter casting 31. In this position of valve 58, inlet tee 38 is coupled to the pumping mechanism within pump module 22. In the second position of valve 58 illustrated in FIGS. 1 and 10, spool passage 62 is oriented orthogonally of inlet passage 48 (FIG. 10). In this position, the inlet tee is thus isolated from the pumping mechanism, with O-ring 64 being oriented toward the inlet tee and preventing leakage around spool 60.

Figure 5:
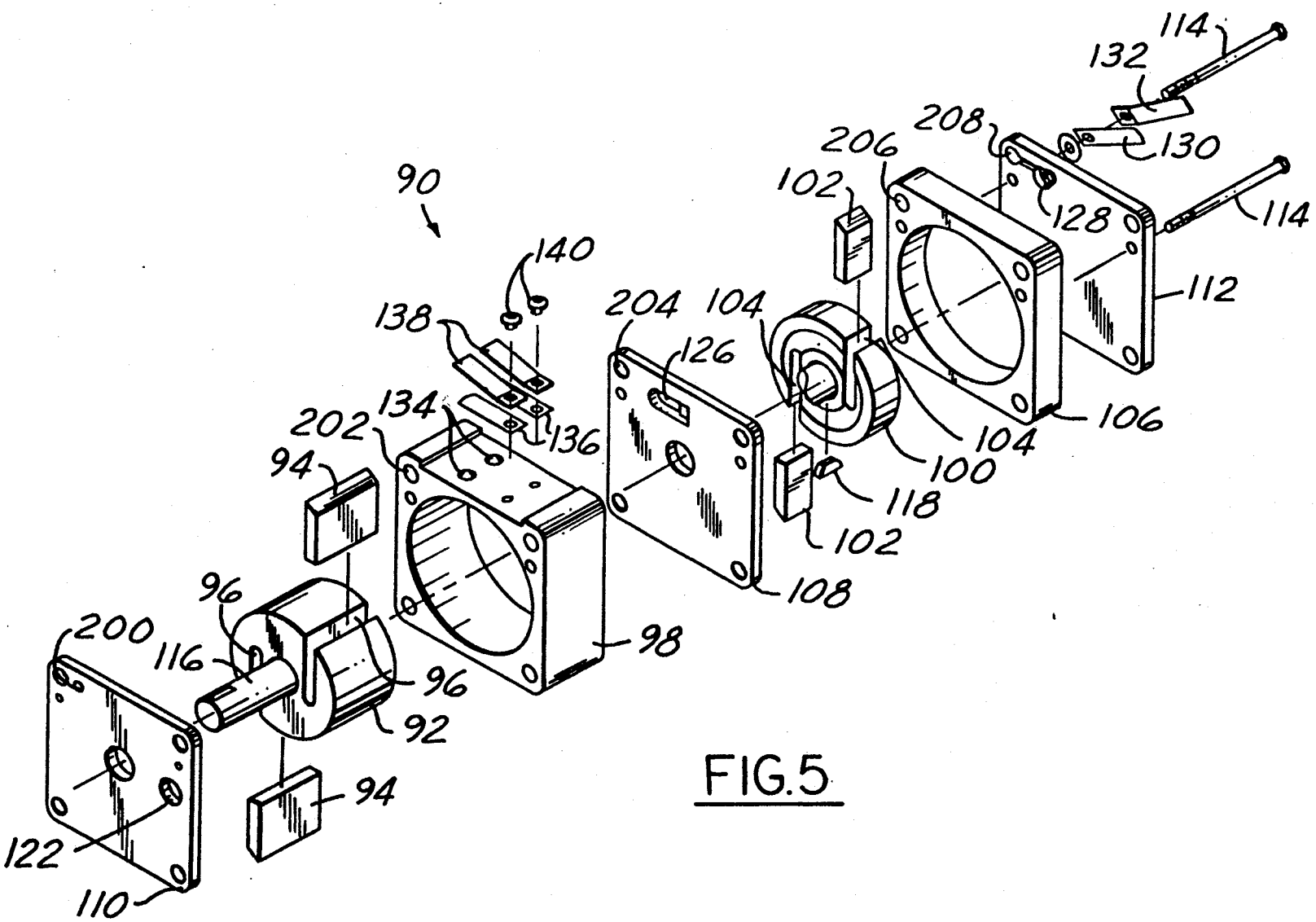
FIG. 5 is an exploded perspective view of the pumping mechanism illustrated in FIGS. 1-4.

Pump module 22 (FIGS. 1, 2 and 4) comprises a two-stage rotary vane pumping mechanism 90 (FIGS. 1, 2 and 5). A first-stage rotor 92 (FIG. 5) carries a pair of vanes 94 in associated slots 96, and is rotatably mounted within a cam ring 98. A second-stage rotor 100 carries a pair of vanes 102 within associated slots 104 surrounded by a second cam ring 106. The rotors are separated by a divider plate 108. An inlet end plate 110 is disposed on the opposing side of cam ring 98 from divider plate 108, and an outlet end plate 112 is disposed on the opposing side of cam ring 106 from divider plate 108. Plates 108,110,112 and cam rings 98,106 are sandwiched in assembly by screws 114 that mount pumping mechanism 90 to the outer face of adapter casting 31. Rotors 92,100 are suitably affixed to a pump drive shaft 116, such as by a key 118. Shaft 116 extends through inlet end plate 110, and through a seal 117 (FIG. 2) in adapter 24. Within adapter 24, shaft 116 is fastened to coupling 36 by a suitable key and clamp arrangement 120 (FIG. 2). As previously noted, coupling 36 is engaged in assembly with coupling 34 (FIG. 6) mounted on motor shaft 30, such that motor 26 drives rotors 92,100 within cam rings 98,106 respectively. Rotors 92,110 are eccentrically positioned within cam rings 98,106 as is conventional in the art, such that rotation of the rotors cooperates with the vanes and cam rings for pumping air through pumping mechanism 90.

Inlet passage 48 (FIGS. 3–4 and 9–10) within adapter casting 31 is aligned in assembly with an opening or port 122 (FIG. 5) in inlet end plate 110 for coupling the inlet passage to the first-stage pumping cavity between rotor 92 and cam ring 98. A sealing ring 124 (FIG. 4) surrounds the downstream end of inlet passage 48 on the surface of adapter 24 opposed to inlet end plate 122. A passage 126 (FIG. 5) in divider plate 108 couples the first-stage pumping cavity to the second-stage pumping cavity between rotor 100 and cam ring 106. A port 128 in outlet end plate 112 couples the second-stage pumping cavity to an open cavity 146 (FIGS. 1–2) within pump module 22 surrounding pumping mechanism 90. A reed valve 130 (FIG. 5) is mounted externally of opening 128, and cooperates in the usual manner with a reed valve limiter 132 for permitting passage of air from pumping mechanism 90 to the surrounding cavity, while limiting reverse flow of air or oil back into the second-stage pump cavity. A pair of secondary outlet ports 134 extend radially through cam ring 98, and cooperate in the usual manner with reed valves 136 and reed valve limiters 138 mounted by screws 140 externally of cam ring 98. Ports 134 provide for direct communication between the first-stage pump cavity and the surrounding chamber, which is useful upon initial start-up of the pump when the pump cavities may be filled with oil. Operation of pumping mechanism 90 per se is generally conventional in the art as disclosed in the above-noted patents, and need not be described further.

A cover 142 (FIGS. 1, 2 and 4) is affixed by screws 144 to the motor-remote endface of adapter 24 enclosing pumping mechanism 90, and thereby forming the generally open cavity 146 into which pumping mechanism 90 opens through outlet end plate 128 (FIG. 5) as previously described. A baffle plate 148 is mounted by screws 150 on adapter 24 within cavity 146, and a porous baffle filter 152 is carried in assembly between baffle 148 and the opposing internal surface of cover 142. A sealing ring 154 is captured between adapter 24 and cover 142. A guard screen 156 is captured in assembly between filter 152 and adapter 24. Within adapter 24, and as best seen in FIG. 1, an outlet cavity 158 above inlet valve 58 communicates in assembly with pump module cavity 146 through guard 156 and filter 152. A sight glass (FIGS. 1 and 2) on the end of cover 142 remote from motor 26 indicates optimum level of oil within pump cavity 146 at a level submersing pump mechanism 90 but spaced from filter 152. An oil fill cap 162 is positioned on the upper side of cover 142, and an oil drain plug 164 is carried at the lower portion of cover 142. During operation, pumping mechanism 90 thus pumps air into cavity 146, and thence through filter 152 and guard 156 to cavity 158 within adapter 24, which thus forms part of the pump outlet passage.

A hollow plastic handle 166 (FIGS. 1 and 6) is affixed at its forward end to adapter 24 by means of a hollow bolt 168 threaded into an opening 169 on adapter casting 31, so that hollow bolt 168 opens into adapter outlet passage cavity 158. An opening 170 adjacent to the upper or thread-remote end of bolt 168 opens into a passage 172 that extends lengthwise of handle 166. Thus, outlet air from the vacuum pump flows through bolt 168 and handle passage 172 to the open end 174 of handle 166, which thus forms the vacuum pump outlet port. Sealing rings 176 surround bolt 168 on opposing sides of bolt opening 170 for sealing engagement with the handle structure. It is to be noted that the outlet passage formed by cavity 158, bolt 168 and passage 170 is open at all times, bolt 168 serving to affix handle 166 to adapter 24 but not serving as an outlet valve. A cap (not shown) is normally placed over outlet end 174 of passage 172 to prevent entry of dirt and the like.

The portion of handle 166 remote in assembly from bolt 168 is affixed by screws 176 (FIGS. 1 and 6) to cylindrical housing 28 of motor 26. Handle 166 thus cooperates with the motor housing to form a hollow enclosure 178 that encloses and protects the motor starting capacitor 180, the motor leads 182, the ground connection 184 and connections to the motor on/off switch 186. A power cord 188 extends from handle enclosure 178, and terminates in a plug 190 suitable for connection to standard utility power for operating the motor. Affixation of handle 166 at its forward end to adapter 24 and at its rearward end to motor 26 not only places the central portion of handle 166 in spaced parallel relation to the motor and adapter, but also balances load on the handle for easing portability. A base 220 (FIG. 1) is affixed to adapter casting 31 by screws (not shown), and carries feet 222 for resting pump 20 on a suitable surface.

Figure 7:
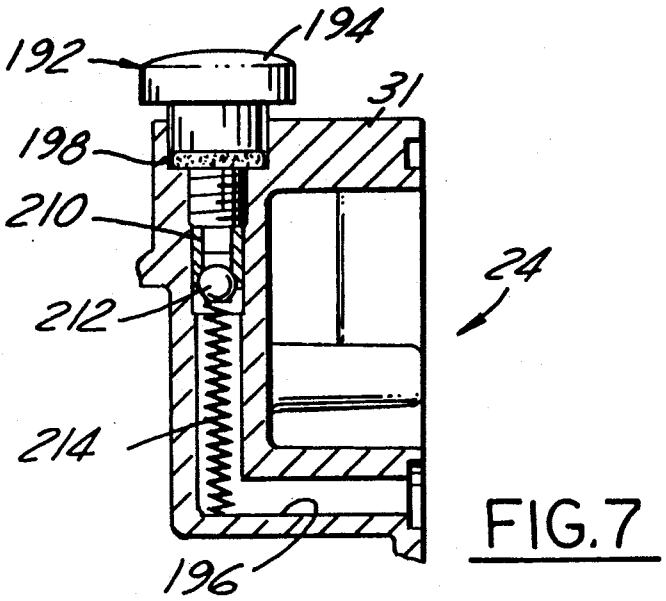
FIG. 7 is a fragmentary sectional view of the gas ballast valve taken substantially along the line 7—7 in FIG. 3.
Figure 8:
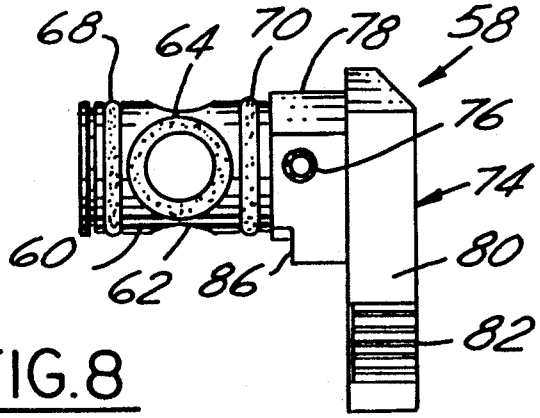
FIG. 8 is an elevational view of the handle and spool forming part of the inlet valve illustrated in FIGS. 1-3.

A gas ballast valve 192 (FIGS. 3 and 7) is mounted on adapter casting 31. Valve 192 comprises a valve element or head 194 removably received within the internal threads at the open end of a gas passage 196. Head 194 carries a sealing ring 198, and may be loosened by an operator for permitting passage of air through the threads around the seal into passage 196. Passage 196 (FIGS. 4 and 7) aligns in assembly with an opening 200 (FIG. 5) in inlet end plate 110 of pumping mechanism 90. A sealing ring 201 (FIG. 4) surrounds the outlet end of passage 196 for engagement in assembly with plate 110. Air flows from end plate opening 200 to passage 202 in cam ring 98, opening 204 in plate 108, passage 206 in cam ring 106, and thence through lateral channel 208 in outlet end plate 112 so as to communicate with outlet opening 128. Thus, as is conventional in the art, valve 192 may be opened by an operator so as to permit entry of dry air into pump cavity 146 surrounding the pumping mechanism, and thereby help prevent condensation and collection of water within the pump cavity.

In accordance with one aspect of the present invention, gas ballast valve 192 further includes a check valve for preventing reverse flow of air and/or oil from the pumping mechanism through the ballast valve. The check valve comprises an annular gasket 210 received within the cylindrical inlet portion of passage 196 adjacent to valve head 194. A check ball 212 is positioned downstream of gasket 210, which forms a valve seat for mating engagement with check ball 212. Check ball 212 is urged against seat/gasket 210 by a coil spring 214, which is captured in compression within passage 196 and seats against an opposing internal surface of passage 196 at the right-angle turn of the gas passage for communication with the pumping mechanism. Thus, the check valve formed by gasket 210, check ball 212 and coil spring 214 permits passage of air from valve head 194 to the pumping mechanism, but prevents reverse flow of air and/or oil from the pumping mechanism out of the gas ballast opening.

There has thus been disclosed a vacuum pump that fully satisfies all of the objects and aims previously set forth. Inlet valve 58 carried by adapter 24 may be readily manipulated by an operator for selectively connecting or isolating the pumping mechanism from the system under service without requiring disconnection or external valve arrangements. The construction of handle 166 not only forms part of the gas outlet passage, but also balances weight of the pump for carrying. The check valve associated with gas ballast valve 192 prevents reverse flow of air and/or oil through the valve.

We claim:

1. A vacuum pump that comprises:

an electric motor having a housing and an output shaft that extends from one end of said housing, a pump module including rotary pumping means, means mounting said module to said one motor housing end and means coupling said rotary pumping means to said motor output shaft, pump inlet means coupled to said pump module, including an inlet port and valve means selectively movable between an open position in which said inlet port is coupled to said pumping means and a closed position in which said inlet port is isolated from said pumping means, and pump outlet means including an outlet port and outlet passage means coupling said pumping means to said output port, said means mounting said module to said motor housing comprising an adapter, said inlet port and said valve means being carried by said adapter, said adapter including inlet passage means extending within said adapter from said inlet port to said pumping means, said valve means being disposed in said inlet passage means and including a handle disposed externally of said adapter for manually moving said valve means between said open position and said closed position.

2. The pump set forth in claim 1 wherein said valve means further comprises abutment means on said handle and said adapter for limiting rotation of said handle and cooperating with said handle for determining said open and closed positions of said valve means at limits of rotation by said handle.

3. The pump set forth in claim 2 wherein said valve means comprises a spool extending laterally through said inlet passage means, and an opening extending laterally through said spool, said handle being coupled to said spool for rotating said spool between a first position in which said opening is aligned with said passage means to connect said inlet port to said pumping means and a second position at which said opening is oriented at a right angle to said passage means to isolate said inlet port from said pumping means.

4. A vacuum pump that comprises:

an electric motor having a housing and an output shaft that extends from one end of said housing, a pump module including rotary pumping means, means mounting said module to said one motor housing end and means coupling said rotary pumping means to said motor output shaft, pump inlet means coupled to said pump module, including an inlet port and vale means selectively movable between an open position in which said inlet port is coupled to said pumping means and a closed position in which said inlet port is isolated from said pumping means, pump outlet means including an outlet port and outlet passage means coupling said pumping means to said output port, said means mounting said module to said motor housing comprising an adapter, said inlet port and said valve means being carried by said adapter, and a hollow handle and means mounting one end of said hollow handle to said adapter, said outlet passage means extending through said adapter and thence through said hollow handle, said output port comprising an open end of said handle remote from said adapter, said means mounting said one end of said handle to said adapter comprising a hollow bolt, said output passage means extending through said bolt.

5. The pump set forth in claim 4 wherein said adapter includes inlet passage means extending within said adapter from said inlet port to said pumping means, said valve means being disposed in said passage means.

6. The pump set forth in claim 4 wherein said inlet valve means comprises inlet passage means within said adapter, a spool extending laterally through said inlet passage means, an opening extending laterally through said spool, and means for rotating said spool between a first position at which said opening is aligned with said passage means and a second position at which said opening is oriented at right angle to said passage means.

7. The pump set forth in claim 4 wherein said handle includes a portion substantially parallel to said motor shaft externally spaced from said motor and adapter, said hollow bolt opening laterally into said handle portion.

8. The pump set forth in claim 7 wherein said handle includes a second portion externally affixed to said motor housing, said second portion being hollow and enclosing electrical connections associated with said motor.

9. A vacuum pump that comprises:

an electric motor having a housing and an output shaft that extends from one end of said housing, a pump module including rotary pumping means, means mounting said module to said one motor housing end and means coupling said rotary pumping means to said motor output shaft, pump inlet means coupled to said pump module including an inlet port and an inlet valve selectively movable between an open position at which said inlet port is coupled to said pumping means and a closed position at which said inlet port is isolated from said pumping means, pump outlet means coupled to said pumping module, and a gas ballast valve on said means mounting said pumping module to said motor, gas passage means coupling said ballast valve to said pumping means for selectively feeding air form said ballast valve to said pumping means from externally of said pump, and a check valve in said gas passage means for preventing reverse flow through said ballast valve from said pumping means, said means mounting said module to said motor housing comprising an adapter, said inlet port, said inlet valve means and said gas ballast valve means being carried by said adapter, said inlet valve means comprising inlet passage means within said adapter, a spool extending laterally through said inlet passage means, an opening extending laterally through said spool, a handle disposed externally of said adapter and coupled to said spool for rotating said spool between a first position at which said opening is aligned with said passage means and a second position at which said opening is oriented at a right angle to said passage means, and abutment means on said handle and said adapter for limiting rotation of said handle cooperating with said handle and said spool for determining said first and second position at limits of rotation of said handle.

10. The pump set forth in claim 9 wherein said check valve comprises a valve seat in said gas passage means, a check ball in said gas passage means an a coil spring in said gas passage means urging said check ball against said seat.

11. The pump set forth in claim 10 wherein said gas passage means includes a substantially cylindrical passage, said valve seat comprising an annular gasket received in said passage.

12. The pump set forth in claim 11 wherein said gas ballast valve comprises internal threads at an open end of said substantially cylindrical passage and means removably received in said threads.

13. The pump set forth in claim 11 wherein said means mounting said module to said motor housing comprises an adapter, said gas ballast valve being mounted on said adapter and said gas passage means extending within said adapter from said ballast valve to said pumping means.

14. The pump set forth in claim 13 wherein said gas passage means within said adapter comprises a right-angle turn between said gas ballast valve and said wall, said spring seating against an opposing internal surface of said gas passage means at said turn.

15. A vacuum pump that comprises:

an electric motor having a housing and an output shaft that extends from one end of said housing, a pump module including rotary pumping means, means mounting said module to said one motor housing end and means coupling said rotary pumping means to said motor output shaft, pump inlet means coupled to said pump module, including an inlet port and valve means selectively movable between an open position in which said inlet port is coupled to said pumping means and a closed position in which said inlet port is isolated from said pumping means, and pump outlet means including an outlet port and outlet passage means coupling said pumping means to said output port, said means mounting said module to said motor housing comprising an adapter, said inlet port and said valve means being carried by said adapter, said adapter including inlet passage means extending within said adapter from said inlet port to said pumping means, said valve means being disposed in said passage means, said valve means comprising a spool extending laterally through said inlet passage means, an opening extending laterally through said spool, a handle disposed externally of said adapter and coupled to said spool for rotating said spool manually by a operator between a first position in which said opening is aligned with said passage means to connect said inlet port to said pumping means and a second position at which said opening is oriented at a right angle to said passage means to isolate said inlet port from said pumping means, and abutment means on said handle and said adapter for limiting rotation of said handle and cooperating with said handle and said spool for determining said first and second position at limits of rotation of said handle.

16. The pump set forth in claim 15 wherein said abutment means comprises a projection on an external surface of said adapter adjacent to said handle and an arcuate slot in said handle receiving said projection.

17. The pump set forth in claim 15 wherein said valve means further comprises sealing means carried by said spool for sealing engagement within said inlet passage means in said second position of said spool to prevent leakage through said inlet passage means around said spool.

18. The pump set forth in claim 15 further comprising a gas ballast valve on said adapter and gas passage means coupling said ballast valve to said pumping means for selectively feeding air from said ballast valve to said pumping means from externally of said adapter.

19. The pump set forth in claim 18 wherein said gas ballast valve comprises a check valve for preventing reverse flow through said ballast valve from said pumping means.

20. The pump set forth in claim 19 wherein said check valve comprises a valve seat in said gas passage means within said adapter, a check ball in said gas passage means and a coil spring in said gas passage means urging said check ball against said seat.

21. The pump set forth in claim 20 wherein said gas passage means includes a substantially cylindrical passage in said adapter, said valve seat comprising an annular gasket received in said passage.

22. The pump set forth in claim 21 wherein said gas ballast valve comprises internal threads at an open end of said substantially cylindrical passage and means removably received in said threads.

23. The pump set forth in claim 21 wherein said gas passage means in said adapter has a right-angle turn between said gas ballast valve and said pumping means, said spring seating against an opposing internal surface of said gas passage means at said turn.

24. A vacuum pump that comprises:

an electric motor having a housing and an output shaft that extends from one end of said housing, a pump module including rotary pumping means, means mounting said module to said one motor housing end and means coupling said rotary pumping means to said motor output shaft, pump inlet means coupled to said pump module, including an inlet port and valve means selectively movable between an open position in which said inlet port is coupled to said pumping means and a closed position in which said inlet port is isolated from said pumping means, and pump outlet means including an outlet port and outlet passage means coupling said pumping means to said outlet port, said means mounting said module to said motor housing comprising an adapter, said inlet port and said valve means being carried by said adapter, said adapter including inlet passage means extending within said adapter from said inlet port to said pumping means, said valve means being disposed in said passage means, said valve means comprising a spool extending laterally through said inlet passage means, an opening extending laterally through said spool, means for rotating said spool between a first position in which said opening is aligned with said passage means to connect said inlet port to said pumping means and a second position at which said opening is oriented at a right angle to said passage means to isolate said inlet port from said pumping means, and sealing means carried by said spool for sealing engagement within said inlet passage means in said second position of said spool to prevent leakage through said inlet passage means around said spool.

25. The pump set forth in claim 24 wherein said means for rotating said spool comprises a handle disposed externally of said adapter and coupled to said spool for manual rotation of said spool by an operator.

26. The pump set forth in claim 25 wherein said means for rotating said spool further comprises abutment means on said handle and said adapter for limiting rotation of said handle and cooperating with said handle and said spool for determining said first and second position at limits of rotation of said handle.

27. The pump set forth in claim 24 wherein said sealing means comprises a circular groove on said spool on an axis orthogonal to said opening in said spool, and an O-ring in said circular groove.

28. The pump set forth in claim 27 wherein said groove and said O-ring are carried by said spool for alignment with said inlet passage means in an orientation facing said inlet port in said second position of said spool.

29. The pump set forth in claim 24 further comprising a hollow handle and means mounting one end of said hollow handle to said adapter, said outlet passage means extending through said adapter and thence through said hollow handle, said outlet port comprising an open end of said handle remote from said adapter.

30. The pump set forth in claim 29 wherein said means mounting said one end of said handle to said adapter comprises a hollow bolt, said outlet passage means extending through said bolt.

* * * * *